US009607551B2

(12) United States Patent
Kim et al.

(10) Patent No.: US 9,607,551 B2
(45) Date of Patent: Mar. 28, 2017

(54) ORGANIC LIGHT-EMITTING DISPLAY DEVICE AND DRIVING METHOD THEREOF

(71) Applicant: SAMSUNG DISPLAY CO., LTD., Yongin, Gyeonggi-Do (KR)

(72) Inventors: Dong Gyu Kim, Yongin-si (KR); Na Young Kim, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 145 days.

(21) Appl. No.: 14/678,477

(22) Filed: Apr. 3, 2015

(65) Prior Publication Data

US 2016/0104425 A1 Apr. 14, 2016

(30) Foreign Application Priority Data

Oct. 13, 2014 (KR) ..... 10-2014-0137770

(51) Int. Cl.
*G09G 3/30* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0861* (2013.01); *G09G 2320/043* (2013.01)

(58) Field of Classification Search
CPC .. G09G 3/3266; G09G 3/3233; G09G 3/3208; G09G 3/3225; G09G 2320/043; G09G 3/3275; G09G 2300/0861
See application file for complete search history.

(56) References Cited

U.S. PATENT DOCUMENTS

2010/0103159 A1 4/2010 Leon
2011/0254871 A1* 10/2011 Yoo ..... G09G 3/3233 345/690
2016/0062522 A1* 3/2016 Yang ..... G06F 3/0412 345/174

FOREIGN PATENT DOCUMENTS

JP 2013-242582 A 12/2013
KR 10-2011-0074999 A 7/2011
KR 10-2012-0019016 A 3/2012
KR 10-2013-0066449 A 6/2013

* cited by examiner

*Primary Examiner* — Adam R Giesy
(74) *Attorney, Agent, or Firm* — Lewis Roca Rothgerber Christie LLP

(57) ABSTRACT

An organic light-emitting display device is provided. An organic light-emitting display device, comprising: a first transistor including a gate electrode connected to a scan line, a first electrode connected to a data line and a second electrode connected to a first node; a second transistor including a gate electrode connected to the first node, a first electrode connected to a first power supply voltage and a second electrode connected to a second node; a third transistor including a gate electrode connected to a sensing control line, a first electrode connected to the scan line and a second electrode connected to the second node; and an organic light-emitting element including an anode electrode connected to the second node and a cathode electrode connected to a second power supply voltage.

20 Claims, 7 Drawing Sheets

ORGANIC LIGHT-EMITTING DISPLAY DEVICE AND DRIVING METHOD THEREOF

CROSS-REFERENCE TO RELATED APPLICATION

This application claims priority to and the benefit of Korean Patent Application No. 10-2014-0137770 filed on Oct. 13, 2014 in the Korean Intellectual Property Office, the disclosure of which is incorporated herein by reference in its entirety.

BACKGROUND

1. Field

The present invention relates to an organic light-emitting display device and a driving method thereof.

2. Description of the Related Art

Organic light-emitting display devices, which have been increasingly highlighted as next-generation display devices, are equipped with self-light-emitting elements, and can thus provide various benefits, such as fast response speed, high emission efficiency, high luminance, and wide viewing angles. Organic light-emitting display devices include organic light-emitting diodes (OLEDs), which are self-light-emitting elements. An OLED includes an anode electrode, a cathode electrode, and organic compound layers formed between the anode electrode and the cathode electrode. The organic compound layers include a hole injection layer (HIL), a hole transport layer (HTL), an emission layer (EML), an electron transport layer (ETL), and an electron injection layer (EIL). In response to a driving voltage being applied to the anode electrode and the cathode electrode, holes transmitted through the HTL and electrons transmitted through the ETL may be moved to the EML, and may form excitons. As a result, the EML may generate visible light.

An organic light-emitting device may deteriorate over time, and may lower the display luminance thereof. The degree to which an organic light-emitting device deteriorates is affected by the brightness of an input image. An organic light-emitting device that has displayed many bright images may deteriorate more severely than an organic light-emitting device that has displayed less bright images. That is, the degree of the deterioration of OLEDs in an organic light-emitting device may vary from area to area. Accordingly, a method has been suggested in which a sensing transistor is added to each pixel. Driving information of a driving transistor according to a sensing voltage is read out and a data voltage to be supplied to each pixel is compensated based on the driving information.

The driving information can generally be read out via data lines, and a readout circuit unit may be incorporated into a data driver integrated circuit (IC). As the resolution of an organic light-emitting display device increases, the number of data driver ICs required may also increase, and as a result, it may become more difficult to arrange, within a limited space, each driver IC with an increased size due to the integration of a readout circuit unit thereinto. Also, since the driving information can be read out via data lines, the capacitance of data lines may increase, and as a result, the amount of heat generated by data driver ICs may also increase. Also, since a leakage path may be formed from a source electrode to a drain electrode, it may be difficult to precisely perform sensing.

SUMMARY

Exemplary embodiments of the present invention provide an organic light-emitting display device capable of precisely measuring driving information of each pixel using a path, other than data lines.

Exemplary embodiments of the present invention also provide a driving method of an organic light-emitting display device capable of precisely measuring driving information of each pixel using a path, other than data lines However, exemplary embodiments of the present invention are not restricted to those set forth herein. The above and other exemplary embodiments of the present invention will become more apparent to one of ordinary skill in the art to which the present invention pertains by referencing the detailed description of the present invention given below.

According to an exemplary embodiment of the present invention, an organic light-emitting display device is provided. An organic light-emitting display device includes a first transistor including a gate electrode connected to a scan line, a first electrode connected to a data line and a second electrode connected to a first node; a second transistor including a gate electrode connected to the first node, a first electrode connected to a first power supply voltage and a second electrode connected to a second node; a third transistor including a gate electrode connected to a sensing control line, a first electrode connected to the scan line and a second electrode connected to the second node; and an organic light-emitting element including an anode electrode connected to the second node and a cathode electrode connected to a second power supply voltage.

The data line and the sensing control line may extend in parallel to each other in a first direction.

The organic light-emitting display device may further include a scan driver configured to supply a scan signal to the scan line.

The organic light-emitting display device may further include a scan driver which may include a shift register configured to generate the scan signal, a sensor configured to measure driving information of the second transistor, a first switch configured to connect the shift register and the scan line, and a second switch configured to connect the sensor and the scan line.

The organic light-emitting display device may further include a controller configured to compensate an input image signal by utilizing the driving information of the second transistor, measured by the sensor.

The organic light-emitting display device may further include a sensing controller configured to supply a sensing control signal to the sensing control line.

The scan driver may be at a first side of a first substrate where the first transistor is arranged and the sensing controller may be at a second side of the first substrate.

The first side and the second side of the first substrate may be perpendicular to each other.

The scan driver and the sensing controller may be at a first side of a first substrate where the first transistor is arranged.

A pulse width of a gate-on voltage of a scan signal, which is supplied to the first transistor, may differ from a pulse width of a gate-on voltage of a sensing control signal, which is supplied to the third transistor.

A channel width-to-channel length ratio of the first transistor may differ from a channel width-to-channel length ratio of the third transistor.

The organic light-emitting display device may include a plurality of pixels, each including the first transistor, the second transistor, and the organic light-emitting element, and wherein some of the plurality of pixels each further comprise the third transistor.

According to an exemplary embodiment of the present invention, an organic light-emitting display device includes a plurality of pixels, each including an organic light-emitting element, a driving transistor configured to drive the organic light-emitting element, a control transistor configured to control the driving transistor, and a sensing transistor; a scan driver configured to supply a scan signal, which turns on the control transistor; and a sensing controller configured to supply a sensing control signal, which turns on the sensing transistor, wherein a driving current is generated in a channel of the driving transistor in response to a sensing voltage being supplied via a first terminal of the turned-on control transistor and the scan driver includes a sensor, which measures the driving current via the turned-on sensing transistor.

The scan driver may be at a first side of a first substrate where the plurality of pixels are formed and the sensing controller is at a second side of the first substrate.

A pulse width of a gate-on voltage of the scan signal may differ from a pulse width of a gate-on voltage of a sensing control signal.

The organic light-emitting display device may further include a controller configured to compensate an input image signal by utilizing the driving current of the driving transistor, measured by the sensor.

According to an exemplary embodiment of the present invention, a method of driving an organic light-emitting display device, which includes a plurality of pixels, each pixel having an organic light-emitting element, a driving transistor driving the organic light-emitting element, a control transistor controlling the driving transistor, and a sensing transistor, and a scan driver turning on the control transistor, includes applying a sensing voltage to a gate terminal of the driving transistor via the control transistor; and measuring a driving current, which is generated in a channel of the driving transistor according to the sensing voltage, wherein the scan driver includes a sensor, which measures the driving current, and the sensor measures the driving current via the sensing transistor that is turned on.

The scan driver may be at a first side of a first substrate where the plurality of pixels are formed and the sensing controller is at a second side of the first substrate.

A pulse width of a gate-on voltage of the scan signal may differ from a pulse width of a gate-on voltage of a sensing control signal.

The driving method of an organic light-emitting display device may further include compensating an input image signal by utilizing the measured driving current.

According to the exemplary embodiments of the present invention, since driving information is sensed via scan lines, any increases in the capacitance of a data driver can be substantially prevented (e.g., prevented), and the data driver is easier to configure.

Also, since driving information is sensed via scan lines, no leakage paths are generated, and as a result, precise measurement data can be provided.

Other features and exemplary embodiments of the present invention will be apparent from the following detailed description, the drawings, the claims, and their equivalents.

DETAILED DESCRIPTION

Figure 1:
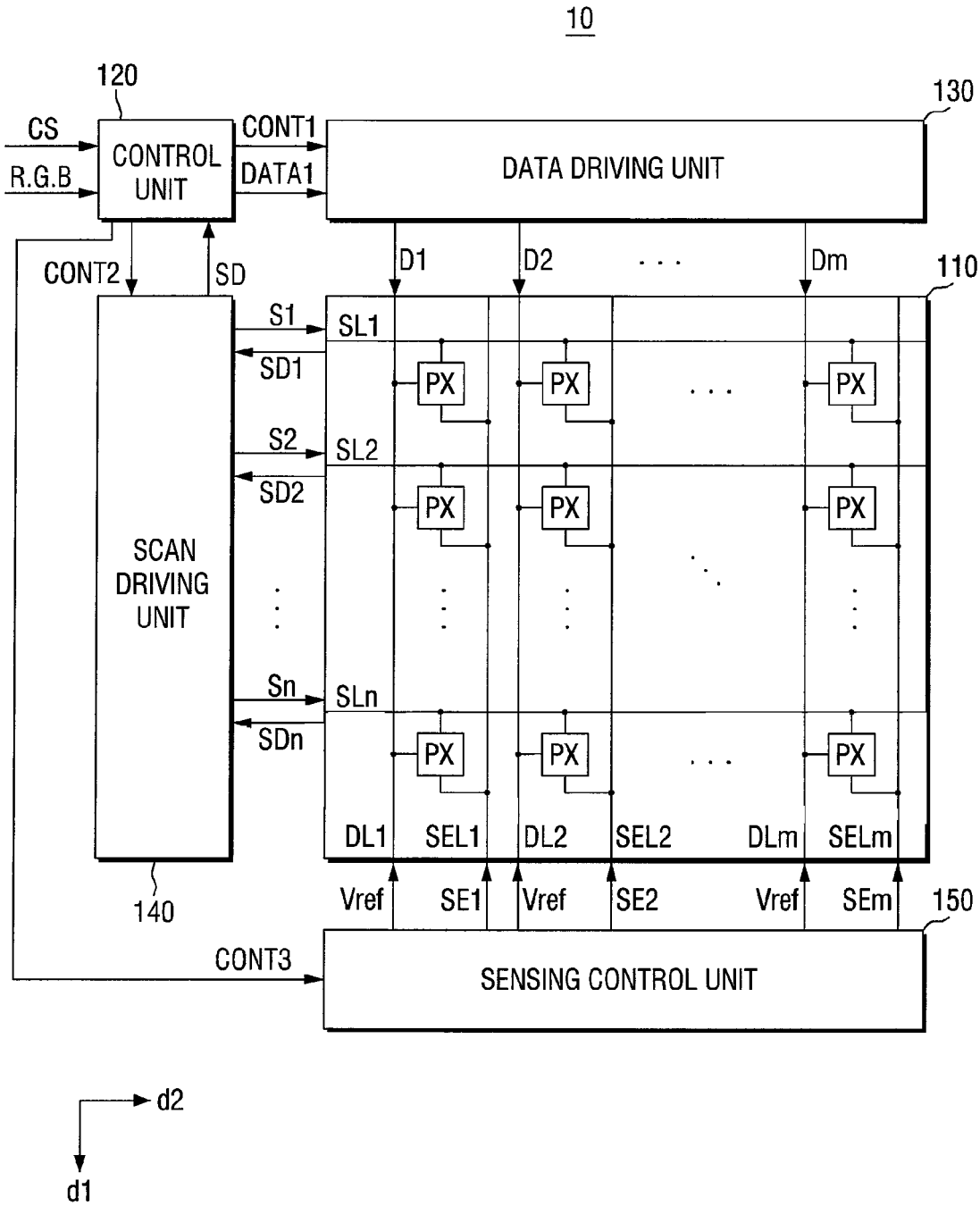
FIG. 1 is a block diagram illustrating an organic light-emitting display device according to an exemplary embodiment of the present invention.

Aspects and features of embodiments of the present invention and methods of accomplishing the same may be understood more readily by reference to the following detailed description of exemplary embodiments of the present invention and the accompanying drawings. The present invention may, however, be embodied in many different forms and should not be construed as being limited to the embodiments set forth herein. Rather, these embodiments are provided so that this disclosure will be thorough and complete and will fully convey the concept of the present invention to those skilled in the art, and the present invention will only be defined by the appended claims. Thus, in some embodiments of the present invention, well-known structures and devices are not shown in order not to obscure the description of embodiments of the present invention with unnecessary detail. Like reference numbers refer to like elements throughout. In the drawings, the thickness of layers and regions are exaggerated for clarity.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on," "coupled to," "connected to," or "adjacent to" another element or layer, it can be directly on, coupled to, connected to, or adjacent to the other element or layer or intervening elements or layers may be present. Alternately, when an element is referred to as being "directly on," "directly coupled to," "directly connected to," or "directly adjacent to" another element or layer, there are no intervening elements or layers present. As used herein, the term "and/or" includes any and all combinations of one or more of the associated listed items.

Spatially relative terms, such as "below," "beneath," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. Further, the use of "may" when describing embodiments of the present invention refers to "one or more embodiments of the present invention."

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the present invention.

Embodiments of the present invention described herein will be described referring to plan views and/or cross-sectional views by way of ideal schematic views of the present invention. Accordingly, the exemplary views may be modified depending on manufacturing technologies and/or tolerances. Therefore, the embodiments of the present invention are not limited to those shown in the views, but include modifications in configuration formed on the basis of manufacturing processes. Therefore, regions exemplified in figures have schematic properties and shapes of regions shown in figures exemplify specific shapes of regions of elements and not limit aspects of the present invention.

Exemplary embodiments of the present invention will hereinafter be described with reference to the accompanying drawings.

Figure 2:
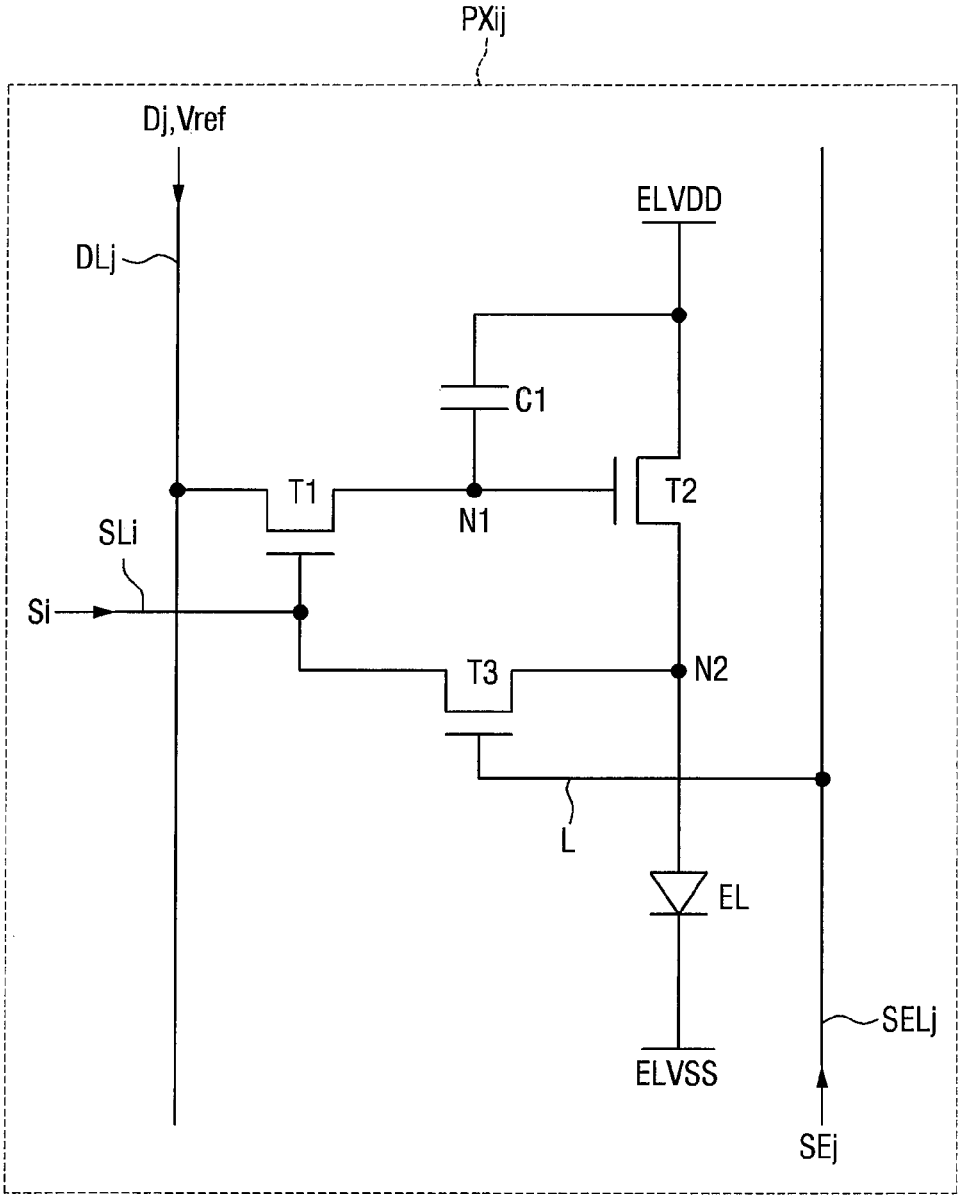
FIG. 2 is a circuit diagram illustrating an example of a pixel according to an exemplary embodiment of the present invention.

FIG. 1 is a block diagram illustrating an organic light-emitting display device according to an exemplary embodiment of the present invention, and FIG. 2 is a circuit diagram illustrating an example of a pixel according to an exemplary embodiment of the present invention.

Referring to FIGS. 1 and 2, an organic light-emitting display device 10 includes a display panel 110, a control unit 120 (e.g., a controller 120), a data driving unit 130 (e.g., a data driver 130), a scan driving unit 140 (e.g., a scan driver 140) and a sensing control unit 150 (e.g., a sensing controller 150).

The display panel 110 may be an image region. The display panel 110 may include a plurality of scan lines (SL1, SL2, . . . , SLn), a plurality of data lines (DL1, DL2, . . . , DLm), which cross the plurality of scan lines (SL1, SL2, . . . , SLn), and a plurality of pixels PX, which are each connected (e.g., coupled, electrically coupled, or electrically connected) to one of the plurality of scan lines (SL1, SL2, . . . , SLn) and one of the plurality of data lines (DL1, DL2, . . . , DLm), wherein n and m are natural numbers different from each other. The plurality of data lines DL1, DL2, . . . , DLm may cross the plurality of scan lines (SL1, SL2, . . . , SLn). That is, the plurality of data lines (DL1, DL2, . . . , DLm) may extend in a first direction d1, and the plurality of scan lines (SL1, SL2, . . . , SLn) may extend in a second direction d2, which crosses the first direction d1. The first direction dl may be a column direction, and the second direction d2 may be a row direction. The plurality of scan lines (SL1, SL2, . . . , SLn) may include first through n-th scan lines SL1 through SLn, which are sequentially arranged along the first direction d1. The plurality of data lines (DL1, DL2, . . . , DLm) may include first through m-th data lines DL1 through DLm, which are sequentially arranged along the second direction d2.

The plurality of pixels PX may be arranged in a matrix form. Each of the plurality of pixels PX may be connected to one of the plurality of scan lines (SL1, SL2, . . . , SLn) and one of the plurality of data lines (DL1, DL2, . . . , DLm). Each of the pixels PX may receive one of a plurality of data voltages (D1, D2, . . . , Dm), via one of the plurality of data lines (DL1, DL2, . . . , DLm) connected thereto in response to one of a plurality of scan signals (S1, S2, . . . , Sn) being provided thereto via one of the plurality of scan lines (SL1, SL2, . . . , SLn) connected thereto. That is, the plurality of scan signals (S1, S2, . . . , Sn) may be provided to the plurality of scan lines (SL1, SL2, . . . , SLn), respectively, and the plurality of data signals (D1, D2, . . . , Dm) may be provided to the plurality of data lines (DL1, DL2, . . . , DLm), respectively. The first direction d1 may be a column direction, and the second direction d2 may be a row direction. Each of the pixels PX may be provided with a first power supply voltage ELVDD via a first power line (not illustrated), and may be provided with a second power supply voltage ELVSS via a second power line (not illustrated). The first power supply voltage ELVDD and the second power supply voltage ELVSS may be provided by a power supply (not illustrated).

The display panel 110 may also include a plurality of sensing control lines (SEL1, SEL2, . . . , SELm), which extend in the same or substantially the same direction as the plurality of data signals (DL1, DL2, . . . , DLm). The plurality of sensing control lines (SEL1, SEL2, . . . , SELm) may include first through m-th sensing control lines SEL1 through SELm, which are sequentially arranged along the second direction d2. The first data line DL1 and the first sensing control line SEL1 may be connected to the same column of pixels, and the rest of the plurality of data lines (DL2, DL3, . . . , DLm) and the rest of the plurality of sensing control lines (SEL2, SEL3, . . . , SELm) may be connected to the same columns of pixels. The plurality of scan lines (SL1, SL2, . . . , SLn) and gate lines (e.g., the plurality of sensing control lines (SEL1, SEL2, . . . , SELm)) may provide signals for turning on different transistors included in each of the plurality of pixels PX. The display panel 110 may be formed by arranging the plurality of pixels PX, the plurality of data lines (DL1, DL2, . . . , DLm), the plurality of scan lines SL1, SL2, . . . ,SLn), and the plurality of sensing control lines SEL1, SEL2, . . . , SELm) on a single substrate. The plurality of data lines (DL1, DL2, . . . , DLm), the plurality of scan lines SL1, SL2, . . . , SLn), and the plurality of sensing control lines SEL1, SEL2, . . . , SELm) may be formed to be insulated from one another.

The controller 120 may receive a control signal CS and an image signal R.G.B. The image signal R.G.B may include luminance information of the plurality of pixels PX. The luminance information may include a predefined number of gray levels, for example, 1024, 256 or 64 gray levels. The control signal CS may include a vertical synchronization signal Vsync, a horizontal synchronization signal Hsync, a data enable signal DE, and a clock signal CLK. The controller 120 may generate first through third driving control signals CONT1 through CONT3 and image data DATA according to the image signal R.G.B and the control signal CS. The controller 120 may generate the image data DATA by dividing the image signal R.G.B in units of frames according to the vertical synchronization signal Vsync and dividing the image signal R.G.B in units of scanning lines (the plurality of scan lines (SL1, SL2, . . . , SLn)) according to the horizontal synchronization signal Hsync. The controller 120 may compensate the image data DATA, and may transmit compensated image data DATA1 to the data driver 130 together with the first driving control signal CONT1. The controller 120 may transmit the second driving control signal CONT2 to the scan driver 140, and may transmit the third driving control signal CONT3 to the sensing controller 150.

The scan driver 140 may be connected to the plurality of scan lines (SL1, SL2, . . . , SLn) of the display panel 110, and may generate the plurality of scan signals (S1, S2, . . . , Sn) according to the second driving control signal CONT2. The scan driver 140 may sequentially apply the plurality of scan signals (S1, S2, . . . , Sn) of a gate-on voltage to the plurality of scan lines (SL1, SL2, . . . , SLn), respectively.

The data driver 130 may be connected to the plurality of data lines (DL1, DL2, . . . , DLm) of the display panel 110. The data driver 130 may sample and hold the compensated image data DATA1 input thereto according to the first driving control signal CONT1, and may convert the compensated image data DATA1 into an analog voltage, thereby generating the plurality of data voltages (D1, D2, . . . , Dm). The data driver 130 may transmit the plurality of data voltages (D1, D2, . . . , Dm) to the plurality of data lines (DL1, DL2, . . . , DLm), respectively. Each of the pixels PX of the display panel 110 may be turned on by one of the plurality of scan signals (S1, S2, . . . , Sn) of the gate-on voltage, and may be provided with one of the plurality of data voltages (D1, D2, . . . , Dm).

The sensing controller 150 may be activated according to the third driving control signal CONT3. The third driving control signal CONT3 may be a signal for controlling the activation or inactivation of a sensing mode. The sensing mode may be activated when a power source for the entire organic light-emitting display device 10 is turned off or turned on. That is, the sensing mode may be activated in a standby period during which the organic light-emitting display device 10 is turned on or off, but the present invention is not limited thereto. That is, the sensing mode may be activated at regular intervals of time, or by a user setting, during the operation of the organic light-emitting display device 10.

The sensing controller 150 may generate a sensing voltage Vref with a level (e.g., a predetermined level) according to the third driving control signal CONT3, and may supply the sensing voltage Vref to the plurality of pixels PX. The sensing voltage Vref may drive an organic light-emitting element EL included in each of the pixels PX at a gray level (e.g., a predetermined gray level). The sensing controller 150 may provide the sensing voltage Vref to the plurality of data lines (DL1, DL2, . . . , DLm). That is, the sensing voltage Vref may be provided to each of the pixels PX via the plurality of data lines (DL1, DL2, . . . , DLm). When the sensing controller 150 provides the sensing voltage Vref, the interconnections from which the plurality of data voltages D1, D2, . . . , Dm are output and the plurality of data lines (DL1, DL2, . . . , DLm) may be disconnected from each other. Also, the sensing controller 150 may determine the levels of a plurality of sensing control signals (SE1, SE2, . . . , SEm) according to the third driving control signal CONT3, and may provide the plurality of sensing control signals (SE1, SE2, . . . , SEm) to the plurality of sensing control lines (SEL1, SEL2, . . . , SELm), respectively. The sensing controller 150 may sequentially provide the plurality of sensing control signals (SE1, SE2, . . . , SEm) to the plurality of sensing control lines (SEL1, SEL2, . . . , SELm), respectively, connected thereto. The sensing controller 150 may be configured to provide both the sensing voltage Vref and the plurality of sensing control signals (SE1, SE2, . . . , SEm), but the present invention is not limited thereto. That is, the sensing voltage Vref and the plurality of sensing control signals (SE1, SE2, . . . , SEm) may be supplied by two different, independent units or controllers.

FIG. 2 illustrates the circuitry of one of the plurality of pixels PX included in the display panel 110. That is, FIG. 2 illustrates the structure of a pixel PXij connected to an i-th scan line SLi and a j-th data line DLj, but the structure of the plurality of pixels PX is not limited to that set forth in FIG. 2.

Referring to FIG. 2, the pixel PXij may include a first transistor T1, a second transistor T2, a third transistor T3, a first capacitor C1 and an organic light-emitting element EL.

The first transistor T1 may include a gate electrode connected to the i-th scan line SLi, a first electrode connected to the j-th data line DLj, and a second electrode connected to a first node N1. The first transistor T1 may be turned on by an i-th scan signal Si of a gate-on voltage, which is applied to the i-th scan line SLi, and may transmit a j-th data voltage Dj, which is applied to the j-th data line DLj, to the first node N1. The first transistor T1 may be a switching transistor selectively providing the j-th data voltage Dj to a driving transistor. The first transistor T1 may be an n-channel field effect transistor (FET). That is, the first transistor T1 may be turned on by a scan signal of a high-level voltage, and may be turned off by a scan signal of a low-level voltage.

The second transistor T2 may include a gate electrode connected to the first node N1, a first electrode connected to the first power supply voltage ELVDD and a second electrode connected to a second node N2. That is, the gate electrode of the second transistor T2 may be connected to the second electrode of the first transistor T1. The first capacitor C1 may be disposed between the first node N1 and the first power supply voltage ELVDD. The first capacitor C1 may be charged with a data voltage provided thereto from the first transistor T1, and the data voltage with which the first capacitor C1 is charged may be supplied to the gate electrode of the second transistor T2. The anode electrode of the organic light-emitting element EL may be connected to the second node N2. The second transistor T2 may be a driving transistor, and may control a driving current applied from the first power supply voltage ELVDD to the organic light-emitting element EL according to the voltage of the first node N1.

The third transistor T3 may include a gate electrode connected to a j-th sensing control line SELj, a first electrode connected to the i-th scan line SLi, and a second electrode connected to the second node N2. The third transistor T3 may be turned on by a j-th sensing control signal SEj, which is applied to the j-th sensing control line SELj. The third transistor T3 may be a sensing transistor. That is, the third transistor T3 may sense information regarding the driving characteristics of the second transistor T2, i.e., the driving current or a driving voltage. When a sensing mode is activated, a sensing voltage Vref with a level (e.g., a predetermined level) may be applied to the gate electrode of the second transistor T2, and a driving current with a magnitude (e.g., a predetermined magnitude) may be generated in the channel of the second transistor T2 due to the sensing voltage Vref. In response to the sensing mode being activated, the third transistor T3 may be turned on, and thus, the driving current may flow from the second electrode to the first electrode of the third transistor T3. The first electrode of the third transistor T3 may be connected to the i-th scan line SLi, and driving information of the pixel PXij may be read out via the i-th scan line SLi, which will be described later in further detail.

The organic light-emitting element EL may include an anode electrode connected to the second node N2, a cathode electrode connected to the second power supply voltage ELVSS, and an organic light-emitting layer (not illustrated). The organic light-emitting layer may emit light of one of three primary colors of light, i.e., red, green and blue. A desired color may be represented by a spatial or temporal sum of the three primary colors of light. The organic light-emitting layer may include a low-molecular organic material or a high-molecular organic material corresponding to each color. The organic material corresponding to each color may generate and emit light according to the amount of current flowing in the organic light-emitting layer.

Figure 3:
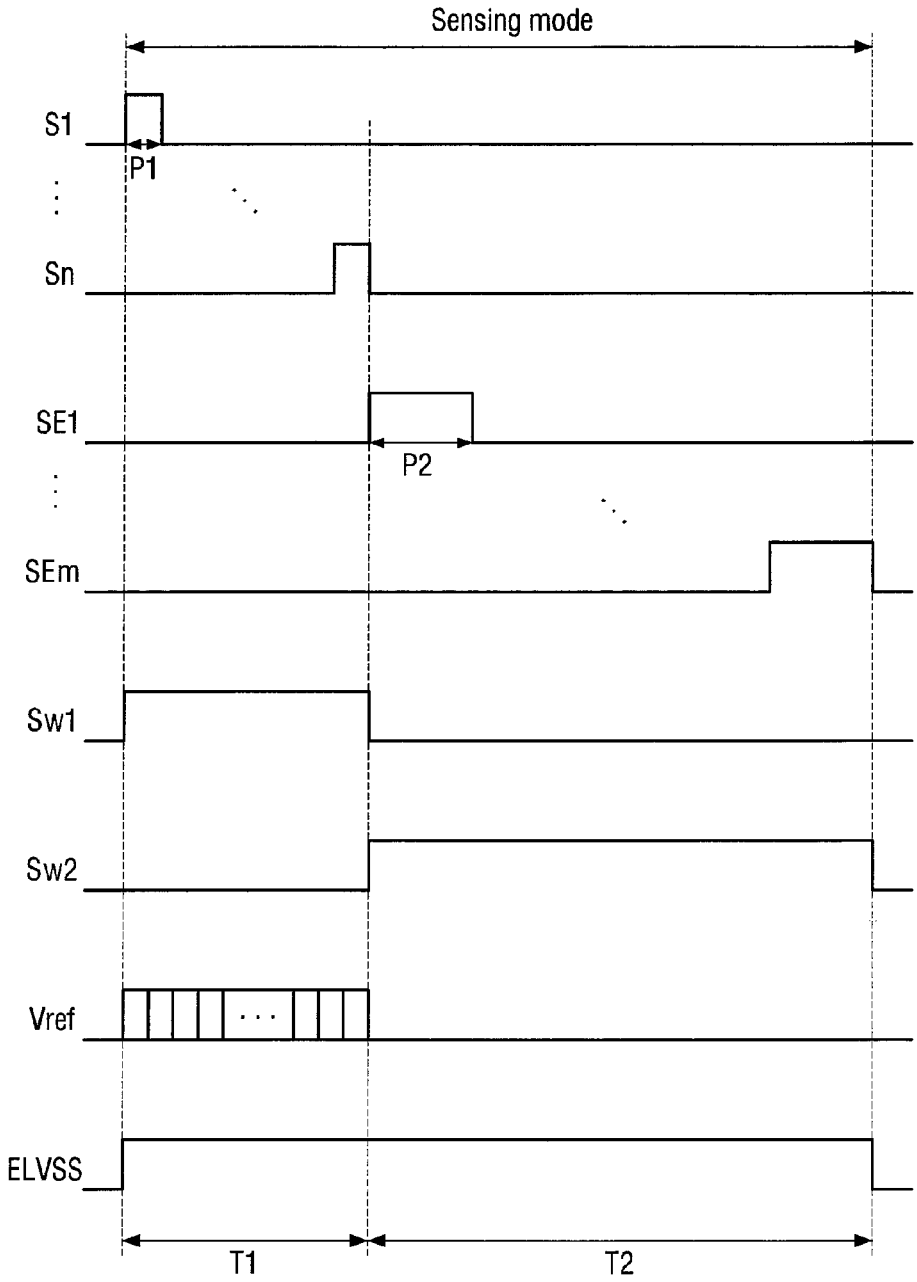
FIG. 3 is a timing diagram illustrating a sensing mode according to an exemplary embodiment of the present invention.
Figure 4:
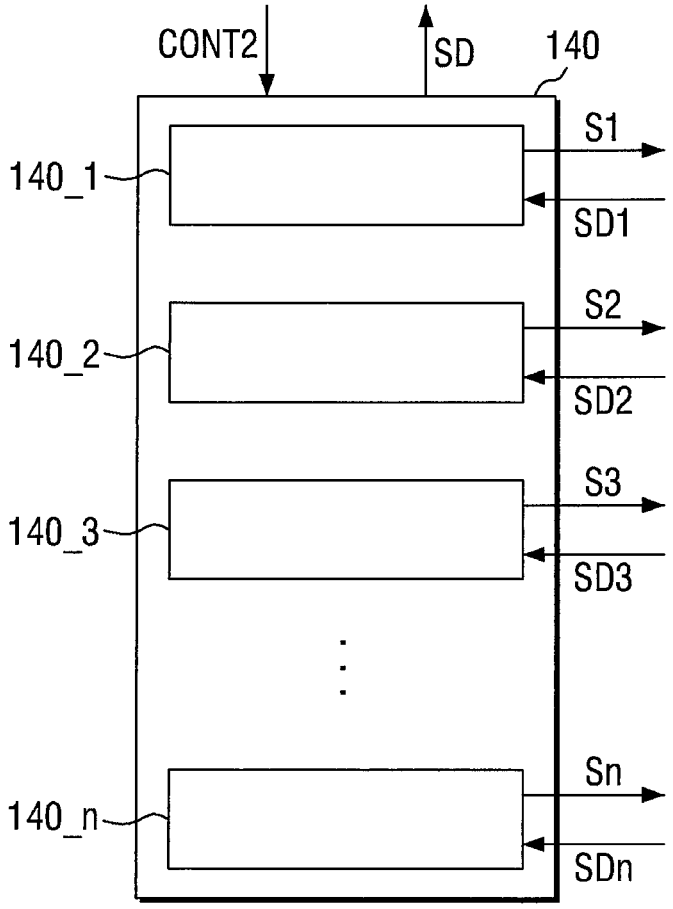
FIG. 4 is a block diagram illustrating a scan driver according to an exemplary embodiment of the present invention.
Figure 5:
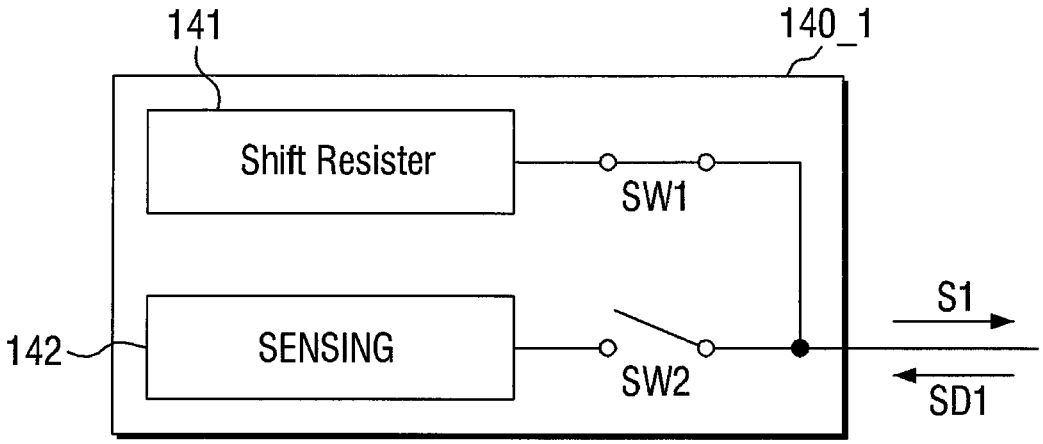
FIG. 5 is a block diagram illustrating a first scan signal circuit portion according to an exemplary embodiment of the present invention.
Figure 6:
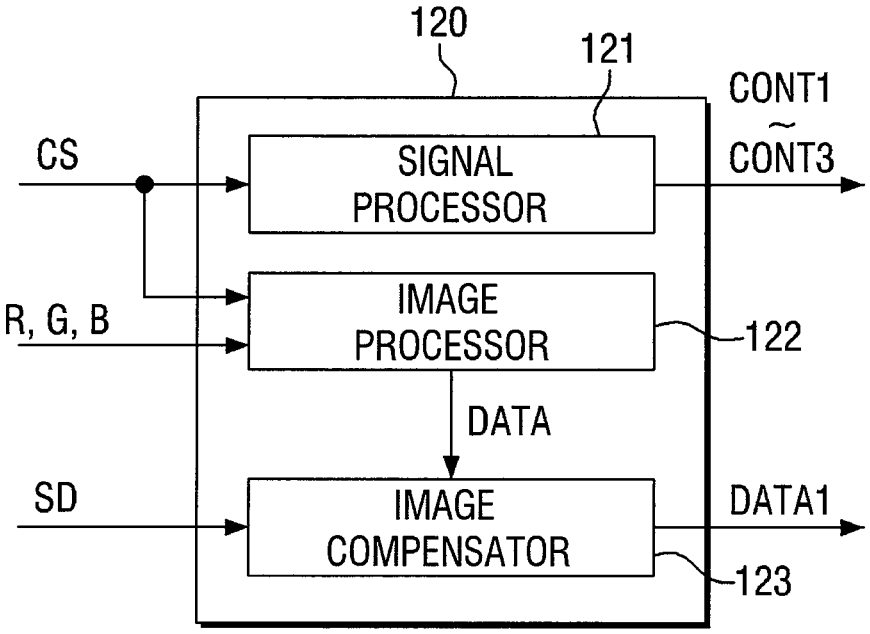
FIG. 6 is a block diagram illustrating a controller according to an exemplary embodiment of the present invention.

FIG. 3 is a timing diagram illustrating a sensing mode according to an exemplary embodiment of the present invention, FIG. 4 is a block diagram illustrating a scan driver according to an exemplary embodiment of the present invention, FIG. 5 is a block diagram illustrating a first scan signal circuit portion according to an exemplary embodiment of the present invention, and FIG. 6 is a block diagram illustrating a controller according to an exemplary embodiment of the present invention.

Referring to FIGS. 3 to 6, a sensing mode may include a first period T1 and a second period T2. The sensing mode may be activated when a power for the entire organic light-emitting display device 10 is turned off or turned on. That is, the sensing mode may be activated during a standby period when the organic light-emitting display device 10 is being turned on or off, but the present invention is not limited thereto. That is, the sensing mode may be activated at regular intervals of time, or by a user setting, during the operation of the organic light-emitting display device 10.

The first period T1 may be a period for applying the sensing voltage Vref, and the second period T2 may be a period for sensing a driving voltage according to the sensing voltage Vref. The second power supply voltage ELVSS may be maintained to be a high-level voltage during the first period T1 and the second period T2. The high-level voltage of the second power supply voltage ELVSS may be the same or substantially the same as a high-level voltage of the first power supply voltage ELVDD. That is, during the sensing mode, the second power supply voltage ELVSS may be maintained to be a high-level voltage and may thus substantially prevent (e.g., prevent) a driving current from flowing into the organic light-emitting element EL. In response to the organic light-emitting display device 10 being switched from the sensing mode to a normal operating mode, the second power supply voltage ELVSS may be switched to being a low-level voltage.

The scan driver 120 may sequentially supply the plurality of scan signals (S1, S2, . . . , Sn) and may thus sequentially turn on the first transistors T1 of the plurality of pixels PX. That is, each of the plurality of scan signals (S1, S2, . . . , Sn) may be applied as a gate-on voltage, and may thus turn on the first transistors T1 of the plurality of pixels PX. The gate-on voltage of each of the scan signals (S1, S2, . . . , Sn) may be a high-level voltage. The scan driver 120 may include a plurality of scan signal circuits (140_1, 140_2, . . . , 140_n), which output the plurality of scan signals (S1, S2, . . . , Sn), respectively. The plurality of scan signal circuits (140_1, 140_2, . . . , 140_n) may be enabled by a scan signal output from their respective previous scan signal circuit to generate a scan signal, and may output the generated scan signal to their respective scan lines and their respective subsequent scan signal circuit. That is, the plurality of scan signal circuits (140_1, 140_2, . . . , 140_n) may sequentially generate and output a scan signal. The plurality of scan signal circuits (140_1, 140_2, . . . , 140_n) may be connected to correspond to the plurality of scan lines (SL1, SL2, SLn), respectively. Accordingly, the scan signal circuits (140_1, 140_2, . . . , 140_n) may be arranged along the column direction.

Each of the scan signal circuits (140_1, 140_2, . . . , 140_n) may include a shift register 141, a sensing part 142 (e.g., a sensor 142), a first switch SW1 and a second switch SW2. The shift register 141 may be a circuit generating a scan signal. The sensor 142 may be a circuit reading out driving information of a pixel PX via a scan line during the second period T2. The first switch SW1 may control the connection between the shift register 141 and a scan line, and the second switch SW2 may control the connection between the sensor 142 and the scan line. Since during the first period T1, a scan signal needs to be supplied to a scan line, a high-level "on" signal may be applied to the first switch SW1, and a low-level "off" signal may be applied to the second switch SW2.

The sensing controller 150 may provide the sensing voltage Vref to each of the plurality of data lines (DL1, DL2, . . . , DLm) during the first period T1. When turned on by the plurality of scan signals (S1, S2, . . . , Sn), the first transistors T1 of the plurality of pixels PX may transmit the sensing voltage Vref, supplied thereto via their respective first electrodes, to the first capacitors C1, connected to their respective second electrodes. The first capacitors C1 may be charged with the sensing voltage Vref. A voltage formed by the first power supply voltage ELVDD and the sensing voltage Vref may be a voltage capable of driving the second transistors T2 of the plurality of pixels PX, and as a result, a driving current may be generated in the channels of the second transistors T2 of the plurality of pixels PX.

The second period T2 may be a period for sensing the driving current. For this, the third transistors T3 of the plurality of pixels PX, which are sensing transistors, may be turned on. That is, during a part (e.g., a predetermined part) of the second period T2, a sensing control signal SE may be sequentially provided as a high-level voltage, and may thus turn on the third transistors T3 of the plurality of pixels PX. The sensing controller 150 may include a plurality of shift registers (not illustrated) for generating the plurality of sensing control signals (SE1, SE2, . . . , SEm), respectively. The plurality of shift registers may be connected to the plurality of sensing control lines (SEL1, SEL2, . . . , SELm), respectively, which extend in parallel with the plurality of data lines DL1, DL2, . . . , DLm. The plurality of shift registers may be arranged side-by-side along the row direction, and may sequentially provide the plurality of sensing control signals (SE1, SE2, . . . , SEm), respectively, along the row direction.

The sensing controller 150 may be arranged on one side of a substrate that constitutes the display panel 110. That is, the sensing controller 150 may be arranged on a first side of the substrate where the first transistors T1 of the plurality of pixels PX are formed. The plurality of shift registers may be mounted on the substrate in a Chip-on-Glass (COG) manner to be arranged along the first side of the substrate. The plurality of shift registers of the scan driver 140 may be mounted on the substrate to be arranged along a second side of the substrate. The first and second sides of the substrate may be perpendicular to each other, but the present invention is not limited thereto.

That is, in an alternative exemplary embodiment of the present invention, the sensing controller 150 and the scan driver 140 may be mounted along a pair of parallel sides of the display panel 110. That is, the sensing controller 150 and the scan driver 140 may be disposed on the left and right sides, respectively, of the display panel 110. In this exemplary embodiment of the present invention, the sensing controller 150 may be connected to a plurality of extension lines (not illustrated), which cross the plurality of sensing control lines SEL1, SEL2, . . . , SELm.

In another alternative exemplary embodiment of the present invention, the sensing controller 150 and the scan driver 140 may be arranged along the same side of the display panel 110. In this exemplary embodiment of the present invention, the sensing controller 150 may be connected to a plurality of extension lines (not illustrated), which cross the plurality of sensing control lines SEL1, SEL2, . . . , SELm, respectively.

Each of the plurality of pixels PX may also include an extension line L, which connects one of the plurality of sensing control lines SEL1, SEL2, . . . , SELm and the gate electrode of a corresponding third transistor T3. The corresponding third transistor T3 may be turned on by a sensing control signal provided thereto. A driving current may flow to a scan line via the corresponding third transistor T3. A high-level "on" signal may be applied to a corresponding second switch SW2. That is, the plurality of scan lines (SL1, SL2, . . . , SLn) may be connected to the sensors 142 of the plurality of scan signal circuits (140_1, 140_2, . . . , 140_n), respectively. The sensors 142 of the plurality of scan signal circuits (140_1, 140_2, . . . , 140_n) may measure the level of the driving current. Alternatively, the sensors 142 of the plurality of scan signal circuits (140_1, 140_2, . . . , 140_n) may connect the driving current to a current sink (not illustrated), and may measure a resulting voltage variation. That is, the sensors 142 of the plurality of scan signal circuits (140_1, 140_2, . . . , 140_n) may measure driving information of the driving transistors T2 of the plurality of pixels PX according to the sensing voltage Vref with the level (e.g., the predetermined level). Each of the sensors 142 of the plurality of scan signal circuits (140_1, 140_2, . . . , 140_n) may include an analog-to-digital converter (ADC), which converts a measured analog voltage into a digital value. A digital value generated by each of the plurality of pixels PX may be mapped to a memory (not illustrated), and may be provided to the controller 120 as sensing data SD.

That is, the organic light-emitting display device 10 may read out the sensing data SD via the plurality of scan lines (SL1, SL2, . . . ,SLn), rather than via the plurality of data lines (DL1, DL2, . . . , DLm) or sensing lines (not illustrated). Accordingly, no additional capacitance may be generated in the plurality of data lines (DL1, DL2, . . . , DLm). Also, since the sensing controller 150 is mounted by being incorporated into the scan driver 140 with a relatively simple structure, rather than into a data driving integrated circuit (IC) with a complicated structure, the design of a data driving IC for high resolution may be facilitated. Also, since the plurality of scan lines (SL1, SL2, . . . ,SLn) are connected to the gate electrodes of the first transistors T1 of the plurality of pixels PX, leakage paths may be reduced or minimized, as compared to the plurality of data lines (DL1, DL2, . . . ,DLm) to which the first electrodes of the first transistors T1 of the plurality of pixels PX are connected. Accordingly, precise measurement data can be read out.

A pulse width P2 of the gate-on voltage of the sensing control signal SE may differ from a pulse width P1 of the gate-on voltage of a scan signal S. For example, the pulse width P2 of the gate-on voltage of the sensing control signal SE may be greater than the pulse width P1 of the gate-on voltage of the scan signal S. That is, for a more precise sensing, the third transistors T3 of the plurality of pixels PX may be turned on for a longer period of time than the first transistors T1 of the plurality of pixels PX. The third transistors T3 of the plurality of pixels PX may have a different channel width (W)-to-channel length (L) ratio, i.e., a different width-to-length (W/L) ratio, from the first transistors T1 of the plurality of pixels PX. The W/L ratio of the third transistors T3 of the plurality of pixels PX may be greater than the W/L ratio of the first transistors T1 of the plurality of pixels PX. That is, the third transistors T3 of the plurality of pixels PX may be formed to have a large channel width W, and may effectively transmit even a low current to the plurality of scan lines (SL1, SL2, . . . , SLn). For example, the W/L ratio of the third transistors T3 of the plurality of pixels PX may be set to be two to three times greater than the W/L ratio of the first transistors T1 of the plurality of pixels PX.

The controller 120 may compensate the image data DATA using the sensing data SD, and may thus generate the compensated image data DATA1. The controller 120 may include a signal processor 121, which generates the first through third driving signals CONT1 through CONT3, an image processor 122, which generates the image data DATA by processing the image signal R.G.B, and an image compensator 123, which compensates for the image data DATA. The image compensator 123 may generate the compensated image data DATA1 based on the sensing data SD provided by the sensing controller 150 and the image data DATA provided by the image processor 122. The compensated image data DATA1 may be data obtained by compensating for the image data DATA for deviations in characteristics between the driving transistors T2 of the plurality of pixels PX and deviations in the degree of deterioration between the organic light-emitting elements EL of the plurality of pixels PX. Since the organic light-emitting display device 10 precisely reads out the sensing data SD by using the plurality of scan lines (SL1, SL2, . . . , SLn), generates the compensated image data DATA1 based on the sensing data SD, and displays an image based on the compensated image data DATA1, the organic light-emitting display device 10 may provide an improved quality of display.

An organic light-emitting display device according to another exemplary embodiment of the present invention will hereinafter be described.

Figure 7:
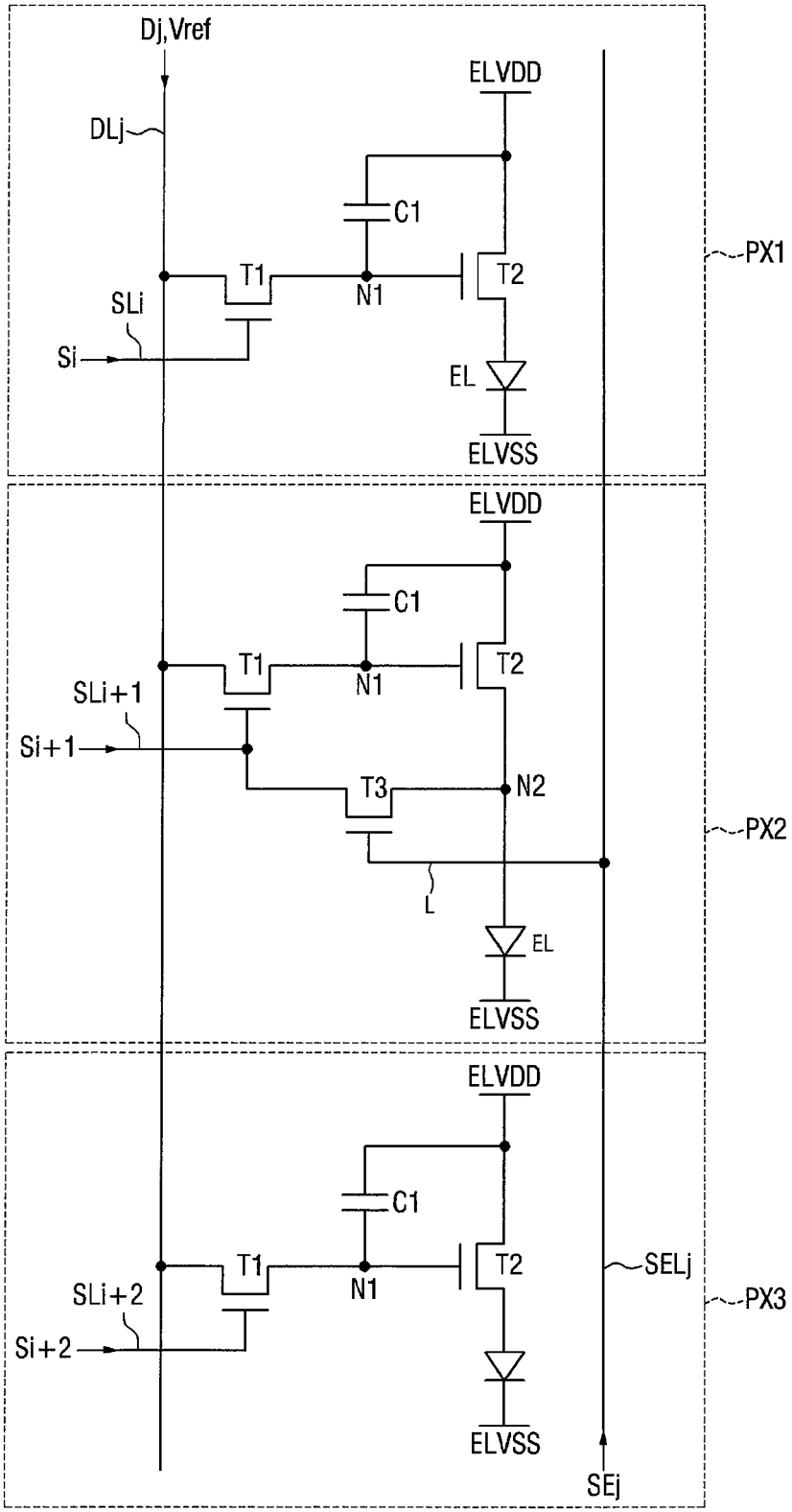
FIG. 7 is a circuit diagram illustrating an organic light-emitting display device according to another exemplary embodiment of the present invention.

FIG. 7 is a circuit diagram illustrating an organic light-emitting display device according to another exemplary embodiment of the present invention. In FIGS. 1 to 7, like reference numerals indicate like elements, and thus, detailed descriptions thereof may be omitted.

Referring to FIG. 7, an organic light-emitting display device according to another exemplary embodiment of the present invention may include a plurality of pixels PX, which are arranged in a matrix. A first transistor T1, a second transistor T2 and an organic light-emitting element EL may be formed in each of the plurality of pixels PX. A third transistor T3 may be formed in some of the plurality of pixels PX. FIG. 7 illustrates a pixel column including first, second and third pixels PX1, PX2, and PX3, which are connected to the same data line. Each of the first, second and third pixels PX1, PX2 and PX3 includes a first transistor T1, a second transistor T2 and an organic light-emitting element EL, but a third transistor T3, which is a sensing transistor, may be provided only in the second pixel PX2. Pixels that are adjacent to one another are likely to display images of similar gray levels, and may thus deteriorate at similar rates. Accordingly, sensing data measured from some pixels may be directly applicable to the compensation of other neighboring pixels for deterioration. That is, sensing data measured from the second pixel PX2 may be used as data for compensating the first and third pixels PX1 and PX3. In the exemplary embodiment of FIG. 7, one or more pixel groups may be defined from the plurality of pixels PX, and a sensing transistor may be formed in one pixel in each of the pixel groups. Accordingly, any cost that may be incurred by forming compensating transistors and any capacitance that may be formed in scan lines may be reduced or minimized while offering the same or substantially the same effect of compensating data.

A driving method of an organic light-emitting display device, according to an exemplary embodiment of the present invention, will hereinafter be described. The driving method includes a step of applying a sensing voltage (S110) and a step of measuring a driving current (S120).

The organic light-emitting display device includes a plurality of pixels PX, and each of the pixels PX includes an organic light-emitting element EL, a driving transistor T2 driving the organic light-emitting element EL, a control transistor T1 controlling the driving transistor T2, and a sensing transistor T3. The organic light-emitting display device also includes a scan driver 140, which turns on the control transistors T1 of the plurality of pixels PX. The organic light-emitting display device may be the organic light-emitting display device of FIGS. 1 to 7, and thus, a detailed description thereof may be omitted. The driving method will hereinafter be described in detail with reference to FIGS. 1 to 7.

A sensing voltage is applied (S110).

The step of applying a sensing voltage (S110) may be the first period T1 of the sensing mode. That is, the sensing controller 150 may be activated according to the third driving control signal CONT3. The third driving control signal CONT3 may be a signal for controlling the activation or inactivation of the sensing mode. The sensing controller 150 may generate a sensing voltage Vref with a level (e.g., a predetermined level) according to the third driving control signal CONT3, and may supply the sensing voltage Vref to the plurality of pixels PX. The sensing voltage Vref may drive an organic light-emitting element EL included in each of the pixels PX at a gray level (e.g., a predetermined gray level). The sensing controller 150 may provide the sensing voltage Vref to the plurality of data lines (DL1, DL2, . . . , DLm). That is, the sensing voltage Vref may be provided to each of the pixels PX via the plurality of data lines (DL1, DL2, . . . , DLm).

When the sensing controller 150 provides the sensing voltage Vref, the interconnections from which the plurality of data voltages (D1, D2, . . . , Dm) are output and the plurality of data lines (DL1, DL2, . . . , DLm) may be disconnected from each other. To transmit the sensing voltage Vref to the gate electrodes of the driving transistors T2 of the plurality of pixels PX, each of the control transistors T1 of the plurality of pixels PX may be turned on by a scan signal. When turned on by the plurality of scan signals (S1, S2, . . . , Sn), the control transistors T1 of the plurality of pixels PX may transmit the sensing voltage Vref, supplied thereto via their respective first electrodes, to the first capacitors C1, connected to their respective second electrodes.

The first capacitors C1 may be charged with the sensing voltage Vref. A voltage formed by the first power supply voltage ELVDD and the sensing voltage Vref may be a voltage capable of driving the second transistors T2 of the plurality of pixels PX, and as a result, a driving current may be generated in the channels of the second transistors T2 of the plurality of pixels PX.

Thereafter, a driving current resulting from the sensing voltage may be measured (S120).

That is, the step of measuring a driving current (S120) may be the second period T2 of the sensing mode. To measure a driving current, each of the third transistors T3 of the plurality of pixels PX, which are sensing transistors, may be turned on by a sensing control signal. The sensing controller 150 may sequentially provide the plurality of sensing control signals (SE1, SE2, . . . , SEn) to the plurality of sensing control lines (SEL1, SEL2, . . . , SELn), respectively, connected thereto. Each of the third transistors T3 of the plurality of pixels PX may have a first electrode connected to the second electrode of a second transistor T2 where a driving current flows, and a second electrode connected to one of the plurality of scan lines (SL1, SL2, . . . , SLn). That is, the scan driver 140 may include a sensor, which measures the driving current. The sensor may measure the driving current via the sensing transistors T3 that are turned on. Each of the plurality of scan lines (SL1, SL2, . . . , SLn) may be connected to a shift register of the scan driver 140, and may thus be supplied with a scan signal in S120. Each of the plurality of scan lines (SL1, SL2, . . . , SLn) may be the sensor of the scan driver 140, and may thus transmit a driving current to the sensor of the scan driver 140 in S120.

In the driving method according to an exemplary embodiment of the present invention, sensing data is read out using scan lines with leakage paths reduced or minimized, and thus, precise measurement data can be provided. Also, any burden caused by capacitance increases from data lines may be reduced, and the design of a data driving IC for high resolution may be facilitated.

The rest of the driving method according to an exemplary embodiment of the present invention is substantially identical to the corresponding description of the organic light-emitting display device of FIGS. 1 to 7, and thus, a further description thereof will be omitted.

While the present invention has been particularly shown and described with reference to exemplary embodiments thereof, it will be understood by those of ordinary skill in the art that various changes may be made therein without departing from the spirit and scope of the present invention as defined by the following claims and their equivalents. The exemplary embodiments of the present invention should be considered in a descriptive sense only and not for purposes of limitation.

What is claimed is:

1. An organic light-emitting display device, comprising:
a first transistor comprising:
a gate electrode connected to a scan line;
a first electrode connected to a data line; and
a second electrode connected to a first node;
a second transistor comprising:
a gate electrode connected to the first node;
a first electrode connected to a first power supply voltage; and
a second electrode connected to a second node;

a third transistor comprising:
a gate electrode connected to a sensing control line;
a first electrode connected to the scan line; and
a second electrode connected to the second node; and
an organic light-emitting element comprising:
an anode electrode connected to the second node; and
a cathode electrode connected to a second power supply voltage.

2. The organic light-emitting display device of claim 1, wherein the data line and the sensing control line extend in parallel to each other in a first direction.

3. The organic light-emitting display device of claim 1, further comprising:
a scan driver configured to supply a scan signal to the scan line.

4. The organic light-emitting display device of claim 3, wherein the scan driver comprises:
a shift register configured to generate the scan signal;
a sensor configured to measure driving information of the second transistor;
a first switch configured to connect the shift register and the scan line; and
a second switch configured to connect the sensor and the scan line.

5. The organic light-emitting display device of claim 4, further comprising:
a controller configured to compensate an input image signal by utilizing the driving information of the second transistor, measured by the sensor.

6. The organic light-emitting display device of claim 3, further comprising:
a sensing controller configured to supply a sensing control signal to the sensing control line.

7. The organic light-emitting display device of claim 6,
wherein the scan driver is at a first side of a first substrate where the first transistor is arranged, and
wherein the sensing controller is at a second side of the first substrate.

8. The organic light-emitting display device of claim 7, wherein the first side and the second side of the first substrate are perpendicular to each other.

9. The organic light-emitting display device of claim 6, wherein the scan driver and the sensing controller are at a first side of a first substrate where the first transistor is arranged.

10. The organic light-emitting display device of claim 1, wherein a pulse width of a gate-on voltage of a scan signal, which is supplied to the first transistor, differs from a pulse width of a gate-on voltage of a sensing control signal, which is supplied to the third transistor.

11. The organic light-emitting display device of claim 10, wherein a channel width-to-channel length ratio of the first transistor differs from a channel width-to-channel length ratio of the third transistor.

12. The organic light-emitting display device of claim 1,
wherein the organic light-emitting display device comprises a plurality of pixels, each comprising:
the first transistor;
the second transistor; and
the organic light-emitting element, and
wherein some of the plurality of pixels each further comprise the third transistor.

13. An organic light-emitting display device, comprising:
a plurality of pixels, each comprising:
an organic light-emitting element;
a driving transistor configured to drive the organic light-emitting element;
a control transistor configured to control the driving transistor; and
a sensing transistor;
a scan driver configured to supply a scan signal, which turns on the control transistor; and
a sensing controller configured to supply a sensing control signal, which turns on the sensing transistor,
wherein a driving current is generated in a channel of the driving transistor in response to a sensing voltage being supplied via a first terminal of the turned-on control transistor, and
wherein the scan driver comprises a sensor, which is configured to measure the driving current via the turned-on sensing transistor.

14. The organic light-emitting display device of claim 13,
wherein the scan driver is at a first side of a first substrate where the plurality of pixels are formed, and
wherein the sensing controller is at a second side of the first substrate.

15. The organic light-emitting display device of claim 13, wherein a pulse width of a gate-on voltage of the scan signal differs from a pulse width of a gate-on voltage of a sensing control signal.

16. The organic light-emitting display device of claim 13, further comprising:
a controller configured to compensate an input image signal by utilizing the driving current of the driving transistor, measured by the sensor.

17. A method of driving an organic light-emitting display device, which comprises a plurality of pixels, each pixel comprising an organic light-emitting element, a driving transistor driving the organic light-emitting element, a control transistor controlling the driving transistor, and a sensing transistor, and a scan driver turning on the control transistor, the driving method comprising:
applying a sensing voltage to a gate terminal of the driving transistor via the control transistor; and
measuring a driving current, which is generated in a channel of the driving transistor according to the sensing voltage,
wherein the scan driver comprises a sensor, which measures the driving current, and
wherein the sensor measures the driving current via the sensing transistor that is turned on.

18. The driving method of claim 17,
wherein the scan driver is at a first side of a first substrate where the plurality of pixels are formed, and
wherein a sensing controller is at a second side of the first substrate.

19. The driving method of claim 17, wherein a pulse width of a gate-on voltage of a scan signal differs from a pulse width of a gate-on voltage of a sensing control signal.

20. The driving method of claim 17, further comprising:
compensating an input image signal by utilizing the measured driving current.

* * * * *